US011542150B2

(12) United States Patent
Saddoris

(10) Patent No.: US 11,542,150 B2
(45) Date of Patent: Jan. 3, 2023

(54) SADDLE PAD FLEX-PLATE

(71) Applicant: Donna M. Saddoris, Urich, MO (US)

(72) Inventor: Donna M. Saddoris, Urich, MO (US)

( * ) Notice: Subject to any disclaimer, the term of this patent is extended or adjusted under 35 U.S.C. 154(b) by 0 days.

(21) Appl. No.: 17/330,496

(22) Filed: May 26, 2021

(65) Prior Publication Data

US 2022/0380198 A1 Dec. 1, 2022

(51) Int. Cl.
*B68C 1/12* (2006.01)
*B68C 1/02* (2006.01)

(52) U.S. Cl.
CPC ..... *B68C 1/12* (2013.01); *B68C 1/02* (2013.01)

(58) Field of Classification Search
CPC .... B68C 1/02; B68C 1/04; B68C 1/12; B68C 1/20; B68C 1/126; B68C 2001/044
See application file for complete search history.

(56) References Cited

U.S. PATENT DOCUMENTS 721,653 A * 3/1903 Amos ..... B68C 1/12
4,965,988 A 10/1990 Anderson
5,343,674 A 9/1994 Brown
5,349,805 A 9/1994 Brown
5,383,328 A 1/1995 Brown
5,503,894 A 4/1996 Brown
6,125,616 A 10/2000 Brown
2008/0110138 A1 5/2008 Helms et al.
2013/0227920 A1 * 9/2013 Munoz ..... B68C 1/12 54/66

FOREIGN PATENT DOCUMENTS

EP 0744376 A1 11/1996

OTHER PUBLICATIONS

The Australian Stock Saddle Co., https://www.colindangaard.com/shop-pads-seat-savers, 3 pages, dated May 24, 2021.
The Equalizer Saddle Pad by Colin Dangaard, https://www.youtube.com/watch?v=aRNksUabfmQ, dated Aug. 2, 2020.

* cited by examiner

*Primary Examiner* — Joshua J Michener
*Assistant Examiner* — Henry Hooper Mudd
(74) *Attorney, Agent, or Firm* — Lathrop GPM LLP

(57) ABSTRACT

An apparatus for insertion into a pocket of a saddle pad of an Equine English saddle. The apparatus includes a plurality of flexible polycarbonate layers encapsulated within a protective polyvinyl chloride skin. The apparatus is positioned within the pocket, on each side of the saddle pad, preventing interference between the shoulder blades of the Equine and the points of the saddle tree during natural movement of the Equine.

17 Claims, 8 Drawing Sheets

SADDLE PAD FLEX-PLATE

FIELD OF USE

The apparatus and system disclosed herein is directed to the reduction of pressure areas under a saddle tree of an English saddle and decrease restriction to natural movement of an Equine caused by the framework of the saddle and associated girths, straps and rigging. The disclosed apparatus and system utilizes layered flex-plates that distribute pressure and facilitate less restricted movement of the scapulae (shoulder blades) of the Equine thereby improving Equine mobility and performance.

BACKGROUND

The apparatus and system disclosed herein is directed to the use of English saddles. English saddles are used to ride horses in English riding disciplines throughout the world. The discipline is not limited to England, the United Kingdom in general, or other countries. This style of saddle is used in all the Olympic and International Federation for Equestrian Sports (FEI) equestrian disciplines, except for the newly approved FEI events of equestrian vaulting and reining.

Most designs were specifically developed to allow for the horse's increased freedom of movement, whether jumping, running, or moving quickly across rugged, broken country with fences. Unlike the western saddle or other saddles with horns, there is no horn or other design element that sticks out above the main tree of the saddle. Different approaches have been used since all species of Equine have been domesticated attempting to alleviate the Equine from excessive pressures created by the saddle tree. The saddle tree is the base on which the rest of the saddle is built, usually constructed of wood or a rigid synthetic material, with metal elements added, such as the stirrup bar and, in some cases, the gullet. It is eventually covered in leather or synthetic material as the saddle is built.

Traditionally, the saddle tree of an English saddle is constructed from laminated layers of high quality wood, reinforced with steel underneath the front arch, and around the rear underside of the tree from quarter to quarter. The sides of the tree that run horizontally along the horse's back are known as bars. Many modern saddle trees are fabricated from spring steel running from front to rear between the bars. These saddle trees are somewhat flexible and are known as "spring trees," with the degree of flexibility varying from saddle to saddle.

More recently, saddle manufacturers are using various materials to replace wood and create a synthetic molded tree. Synthetic materials vary widely in quality. Polyurethane trees are often very well-made and some inexpensive saddles are made with fiberglass trees.

Leather is added on all sides of the tree to create the seat, flaps and panels. The panels are the part of an English saddle which provides cushioning between the horse's back and the saddle. They allow adjustment in fitting the saddle to the horse and are important. Often stuffed with wool or foam flocking, or maintained by sealed air pockets. The panels under the cantle (back of the saddle, which is raised higher than the seat to give security) are called the "rear panels." Those at the front of the saddle are called the "front panels." However, the rear and front panels are one continuous unit, which can be seen if the saddle is flipped over. The saddle has two panels total, one on each side of the horse's spine.

The terms saddle blanket, saddle pad, and saddle cloth refer to blankets, pads or fabrics inserted under a saddle. These are usually used to absorb sweat, cushion the saddle, and protect the horse's back. Saddle blankets have been used for many centuries with all types of saddles. Some are a single thickness, others are made to be folded and used with a double thickness. Although a pad or blanket cannot take the place of a properly fitted saddle, pads with shims or blankets with a special design can partially compensate for minor fitting problems.

English saddles typically use a shaped pad. The original purpose of the English saddle pad was simply to protect the saddle from dirt and sweat, as the panels of the English saddle provided the necessary padding and protection for the horse. The pad is shaped to fit the outline of the saddle and are also used to alter the balance of a saddle and to compensate for fit problems. In addition, square pads have become a popular style for show jumping and dressage, in part because of the ability to add insignia to the corners. There are additional newer types of English saddle pads such as the "riser" pad, which is thicker in the back than the front. Other pads are made with an opening to allow extra room for the withers of the horse, some are shaped to compensate for lordosis or swayback, and many modern materials are used, such as gel or memory foam to absorb shock, and modern synthetic materials with wicking properties to absorb moisture.

The objective of saddle pads presently available in the industry is to protect the area of the Equine's back that are exposed to the saddle. The average saddle pad can do little to keep a saddle from impinging on the rotating scapulae (shoulder blades) of an Equine while they are in motion. Rigging and girths often must be fitted to an individual animal for optimum placement of the saddle on a given Equine's back.

SUMMARY

The apparatus and system disclosed herein places emphasis on distributing localized pressure points and protecting the Equine from the pressure points caused by flexion during movement due to the rigidity of the saddle tree. The apparatus and system disclosed herein relieve the pressure behind the scapulae of the Equine and allows for freer movement.

The flex-plate design disclosed herein integrates technology that will help distribute the pressure over a greater area on the Equine whether it be the back of the Equine or other parts, thus reducing pressure points and reducing discomfort for both Equine and rider. This invention does this by cutting, layering and bonding a polycarbonate polymer into a combination of different lengths, shapes and thickness to achieve maximum performance, comfort, and protection at saddle stress points.

The flex-plate technology is sewn into saddle pads at the withers (the ridge between the shoulder bones), along the spine, to the flanks, creating a base for the saddle tree to rest upon, which distributes the weight of the rider and saddle tree pressure more evenly over the Equine's back. This distribution system allows the Equine to be more balanced, and have greater range of motion, thereby reducing pain and sore areas. This invention increases comfort and stability of the Equine and rider under saddle.

The apparatus and system disclosed herein differs from previously disclosed apparatus and systems by using layered bonding technology that encapsulates a polycarbonate flex-plate system, increasing longevity of the product and overall product performance. The design and manufacturing methods are unique to any saddle pad design on the market today. The layering of materials within the flex-plate allows for movement of the Equine musculoskeletal system under saddle that has not been achieved by any other invented mechanism.

The practical applications of the apparatus and system disclosed herein are that the apparatus will be used as a permanent solution for Equine performance under saddle. Specific to the many English riding disciplines, this saddle pad technology can be used in dressage, hunter jumper, hack, English pleasure riding, polo, endurance riding, fox hunting and Eventing and all riding in which the rider uses an English, or English type, saddle for their Equine. This includes hybrid type saddles that use similar structure and girthing in comparison to a traditional English saddle.

Many different approaches to remedy the limited range of motion from English saddles have been developed since Equine have been domesticated. The designs have attempted to alleviate the Equine from excess and damaging pressures created by the saddle tree. Before the invention of alternative transportation, modern farming equipment and hauling of goods, Equine were an integral part of developing the civilized world we know today. Equine and their human caretakers have moved from a co-dependent relationship of the past to a more evolved relationship of respect and enjoyment. The problem of alleviation of saddle pressure is as relevant today as it has been for centuries past. Currently no product has been completely successful in solving this problem.

The typical saddle pad can do little to keep a saddle from impinging on the rotating scapulae of an Equine while they are in motion. Rigging and girths often must be specialized to individual animals for optimum placement of the saddle on a given Equine's back. The apparatus and system disclosed herein place emphasis on lessening, and preferably eliminating, pressure points and protecting the Equine from the pressure points caused during movement of the horse's scapulae during normal movement of the Equine.

It is an object of the apparatus disclosed herein to improve the range of motion of the scapulae of an Equine when under an English saddle.

It is a further object of the apparatus disclosed herein to improve the performance of an Equine under an English saddle due to improved range of motion of the scapulae.

It is a further object of the apparatus disclosed herein to more broadly distribute the saddle bar pressure.

It is a further object of the apparatus as disclosed herein to utilize polycarbonate layers that are highly durable and capable of withstanding high cyclical loads without fracturing.

It is a further object of the apparatus as disclosed herein to encapsulate the polycarbonate layers in PVC to absorb and attenuate the loading from the movement of the Equine.

DETAILED DESCRIPTION

Figure 1:
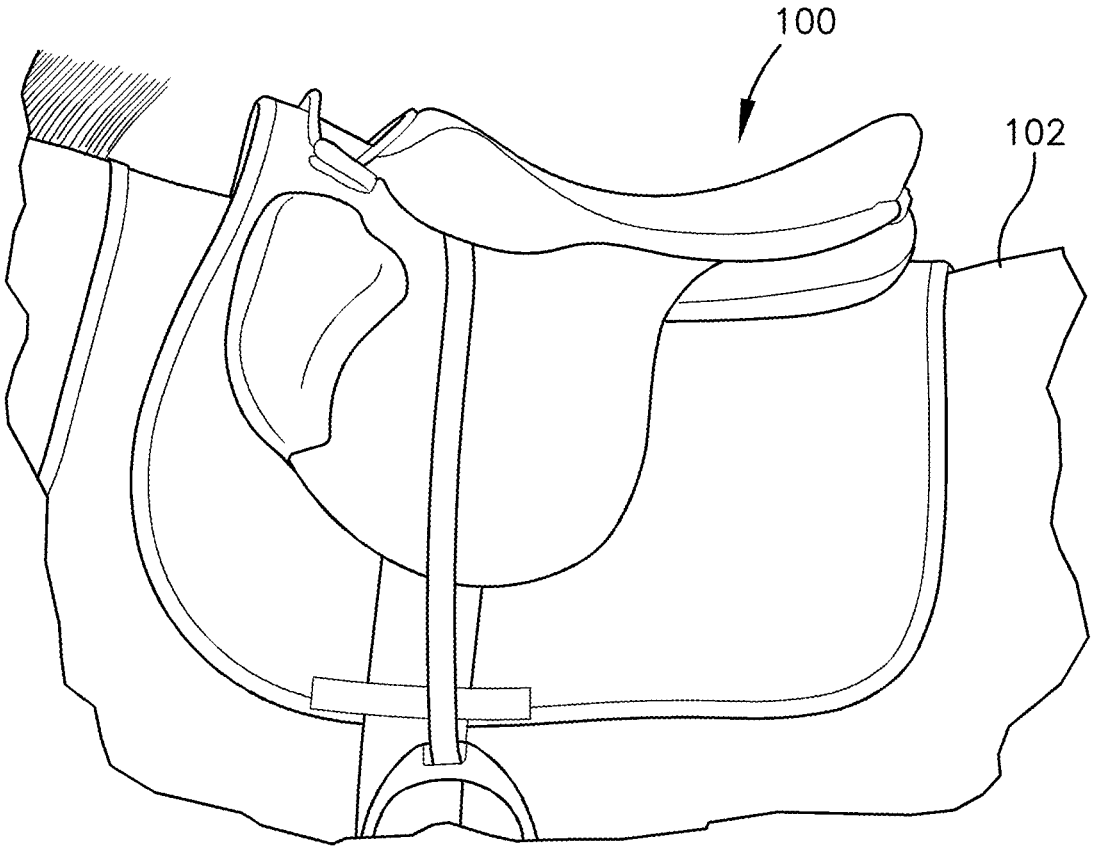
FIG. 1 illustrates an embodiment of an English Equine saddle atop the back of an Equine.
Figure 2:
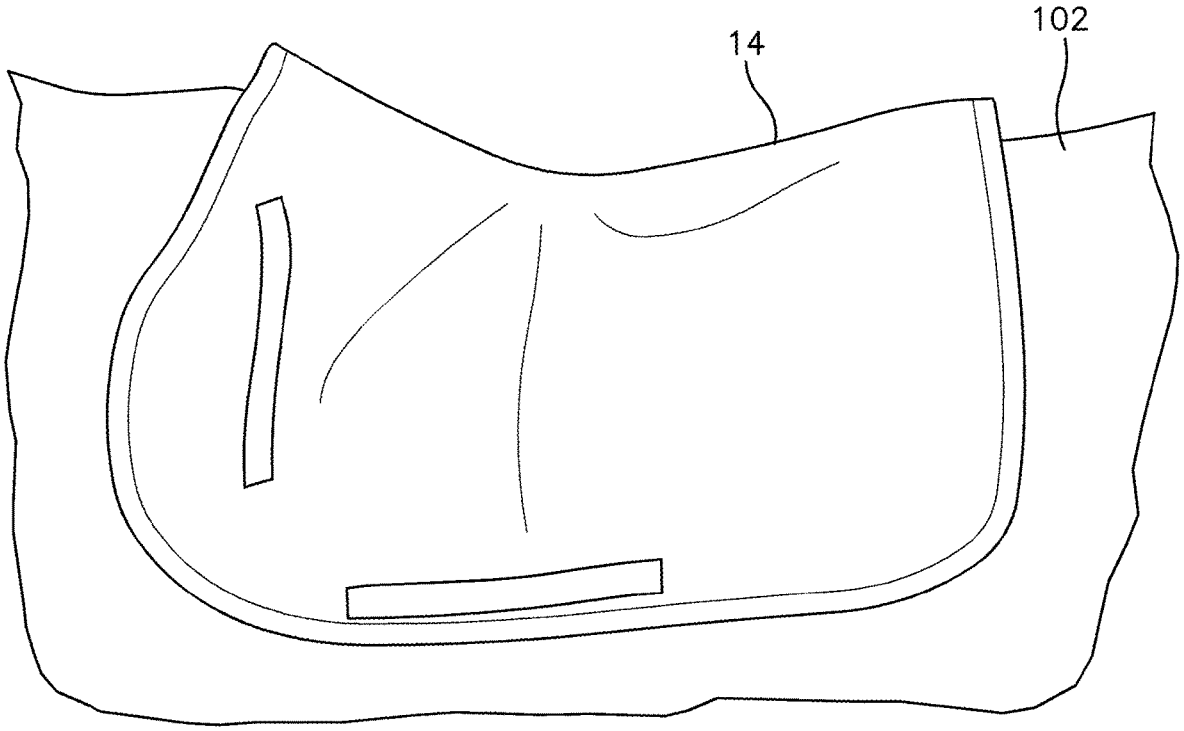
FIG. 2 illustrates an embodiment of a left-side of an English Equine saddle pad atop the back of an Equine.
Figure 3:
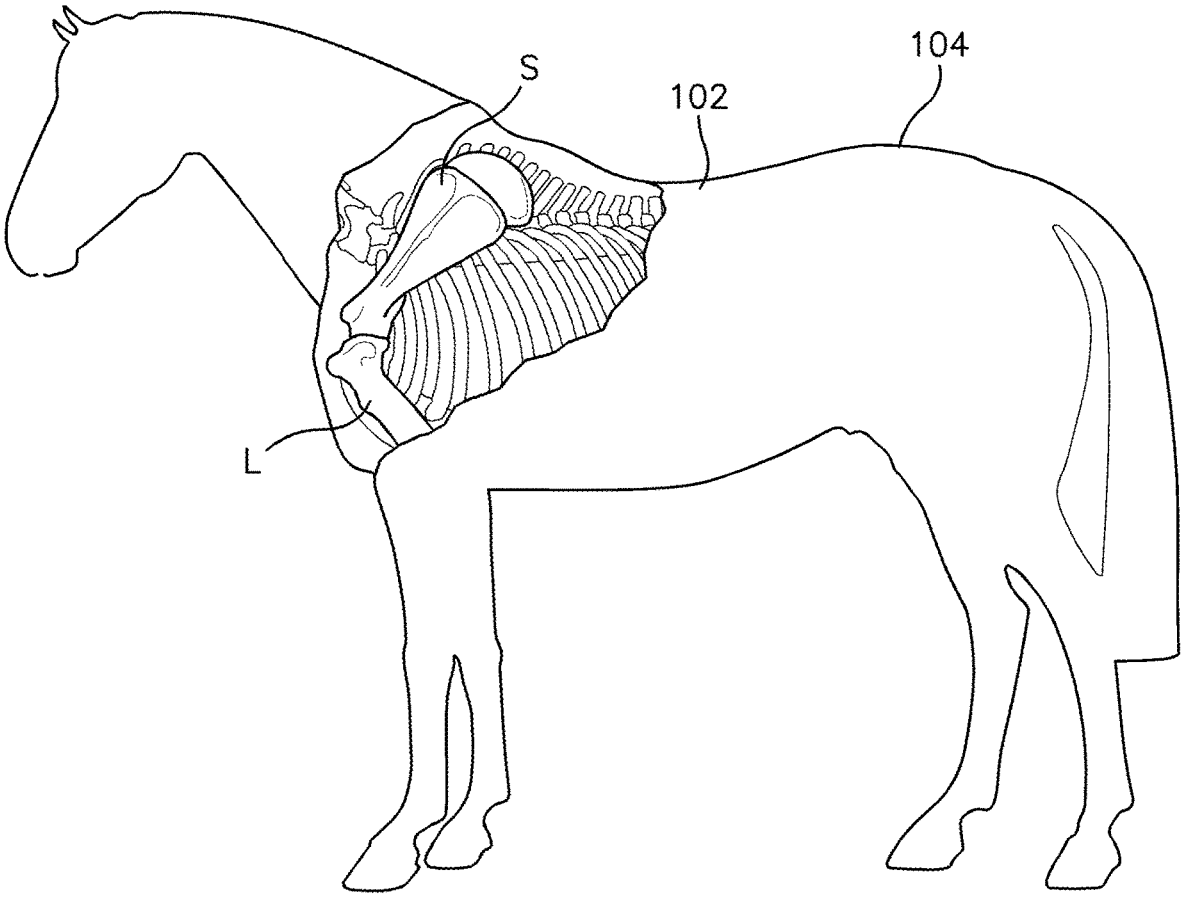
FIG. 3 illustrates the skeletal framework of an Equine with specific reference to the Scapula of the Equine.

The apparatus and system disclosed herein are directed to the use of English saddles. A typical English saddle 100 is illustrated in FIG. 1 atop a saddle pad 14 that is illustrated in FIG. 2. Both the English saddle 100 and the saddle pad 14 are shown positioned upon the back 102 of an Equine 104. To provide some context for discussions later in this disclosure an Equine's shoulder blade, also known as the scapula S, as illustrated in FIG. 3, is a large paddle-shaped bone connected to the Equine's upper leg bone L.

Powerful muscles engage to pull the scapula S backward in full stride. If the Equine's scapula is impeded by either saddle or rider pressure, the impediment changes how an Equine's entire body travels and can result in injury to both the Equine 104 and the rider. English saddles 100 made to fit the Equine's shoulder shape when standing can still cause pain when the Equine tries to travel naturally. The disclosure made herein provides an apparatus and system for overcoming the deficiencies of the current saddle and saddle pad products.

Figure 4:
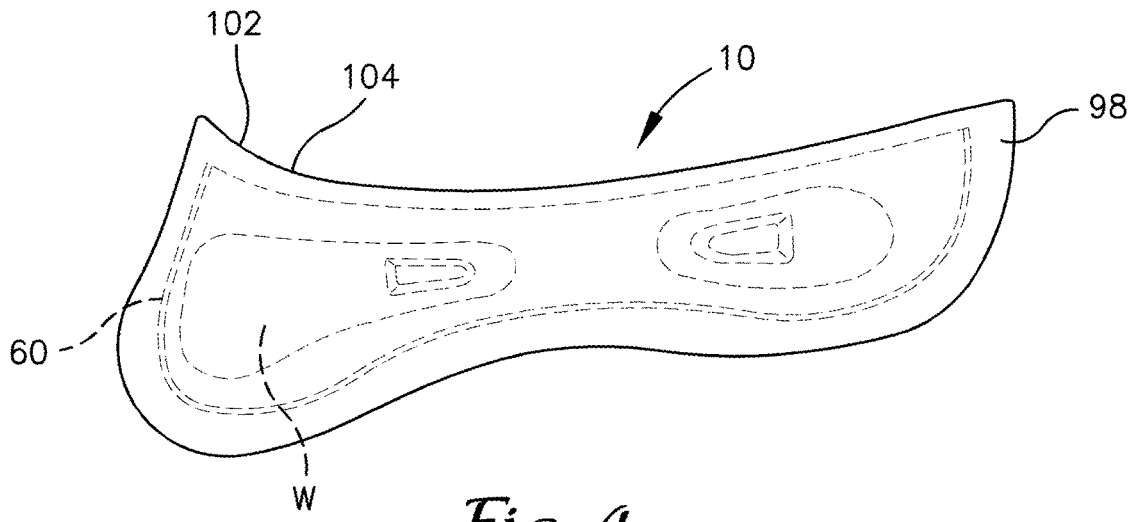
FIG. 4 illustrates an embodiment of an encapsulated flex-plate apparatus for placement on the left side of a saddle pad.
Figure 5:
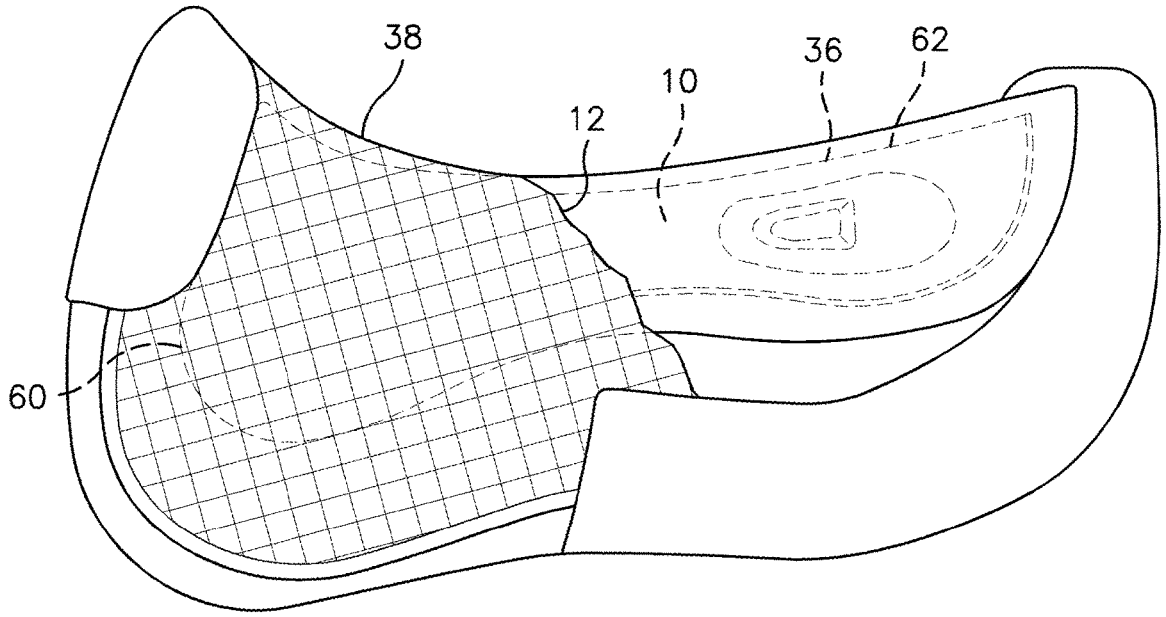
FIG. 5 illustrates a left-side embodiment of the encapsulated flex-plate apparatus in the pocket of a saddle pad.

The flex-plate apparatus 10 in fully assembly form and set in position atop a saddle pad is illustrated in FIG. 4. The flex-plate apparatus 10 illustrated in FIG. 4 is an embodiment configured for placement in the saddle pocket on the left side of the Equine. The apparatus disclosed herein is intended for both left and right-side embodiments. The left and right-sides are mirror images of one another and are not interchangeable; however, it is to be understood that throughout this disclosure left and right-side embodiments are contemplated even though specific reference to a side of the Equine is not referenced. To provide additional clarity, several of the figures disclosed herein specifically identify the side of the Equine against which the apparatus 10 is positioned. As illustrated in FIG. 5, the flex-plate apparatus 10 is disposed within a pocket (shown in cutaway) 12 of the saddle pad 14, there being a saddle pad pocket 12 on each side (left-side and right-side) of the spine of the Equine 104.

Figure 6:
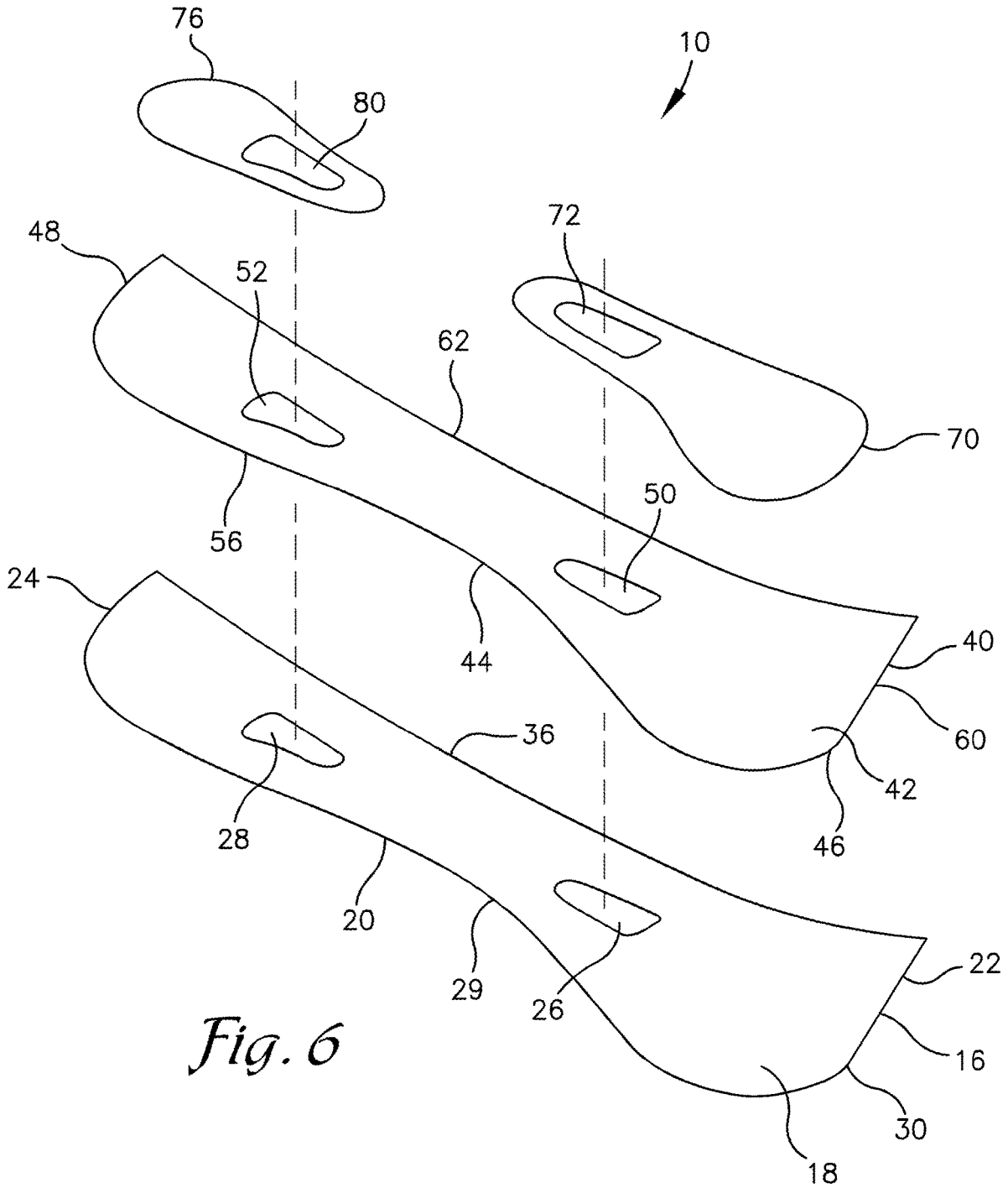
FIG. 6 illustrates an exploded assembly view of a left-side embodiment of the saddle flex-plate.

The flex-plate apparatus 10 is fabricated from multiple layers. As illustrated in FIG. 6, the flex-plate apparatus includes a first layer 16 with an inner face 18 and an outer face 20. The first layer 10 also includes first and second longitudinal ends 22, 24. A first cutout 26 in the first layer 10 is located proximate the first end 22 and a second cutout 28 proximate the second end 24. The outer edge 29 of the first layer 16 includes a linear edge segment 30 and a longitudinally extending upper edge 36, as further illustrated in FIG. 6. In a preferred embodiment, the first layer 16 is preferably fabricated from a polycarbonate material and more preferably is fabricated from Lexan™ with a thickness in the range of 0.015 to 0.025 inches.

Figure 9:
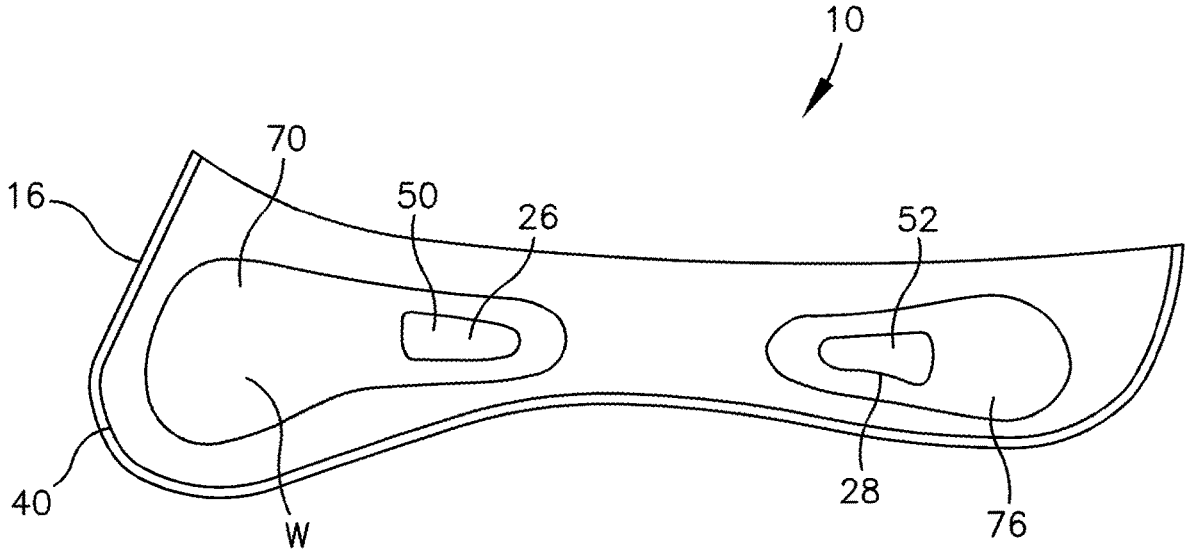
FIG. 9 illustrates a left-side embodiment of the assembled insert.

As again illustrated in FIG. 6, positioned atop the first layer 16 is a second layer 40 with an inner face 42 and an outer face 44. The second layer 40 has slightly lesser dimensions than the first layer 16 as can be seen in FIGS. 4, 5 and 9 by close examination of the location of the outer edges 29, 56 except that the uppermost edges 36, 52 of the first and second layers 16, 40 are flush with one another. The second layer 40 also includes first and second longitudinal ends 46, 48 and a third cutout 50 proximate the first end 46 and a fourth cutout 52 proximate the second end 48. The third and fourth cutouts 50, 52 of the second layer 40 overlay the first and second cutouts 26, 28 of the first layer 16. The cutouts 50, 52 of the second layer 40 are preferably of roughly the same shape and dimensions as the cutouts 26, 28 of the first layer 16.

Figure 7:
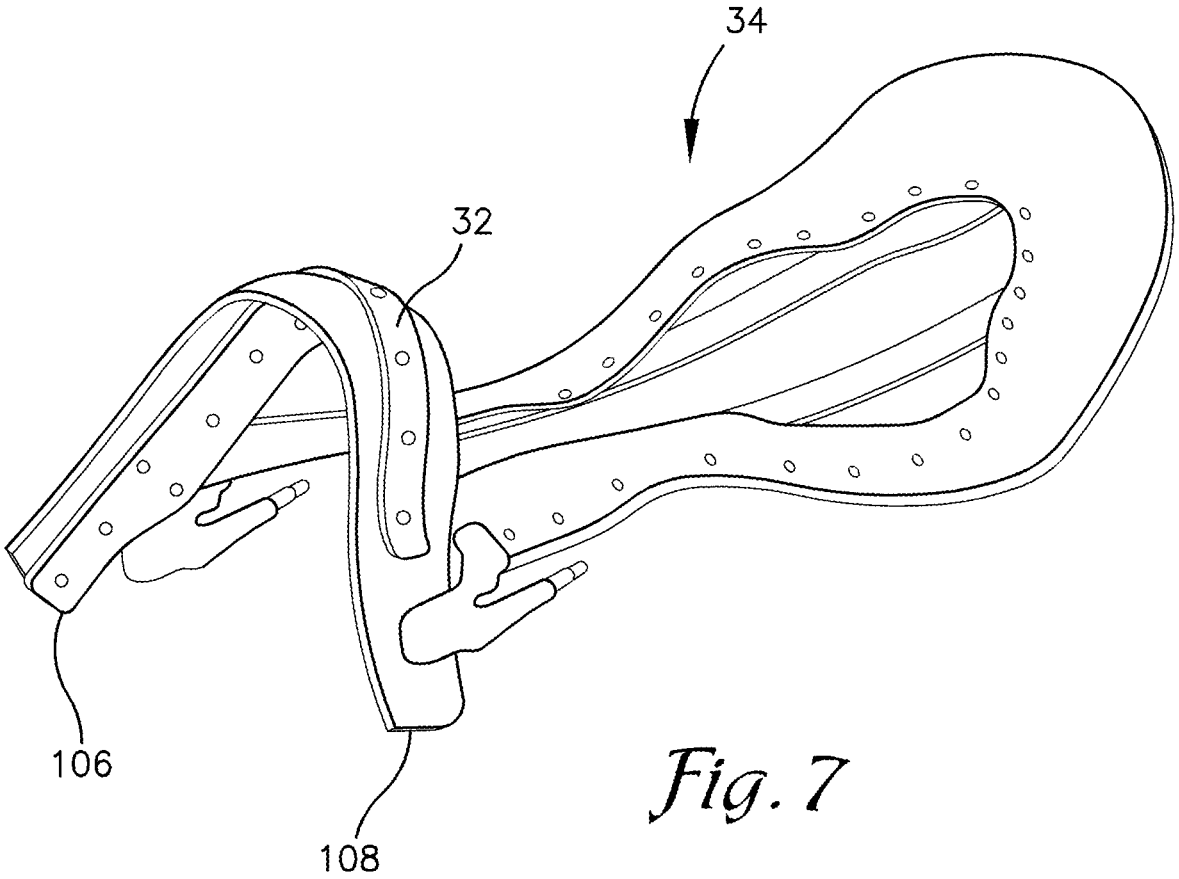
FIG. 7 illustrates an embodiment of a saddle tree of a saddle utilized in conjunction with the saddle pad and flex-plate disclosed herein
Figure 8A:
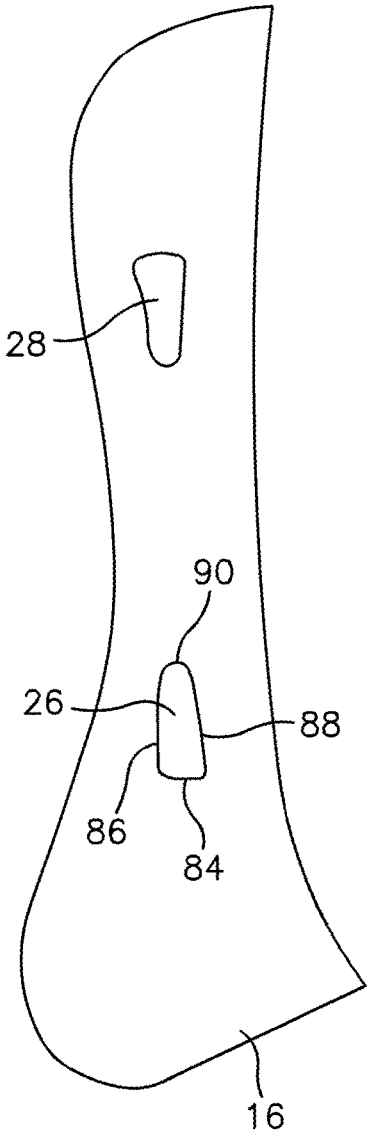
FIG. 8A illustrates a left-side embodiment of a first layer of the flex-plate apparatus disclosed herein.
Figure 8B:
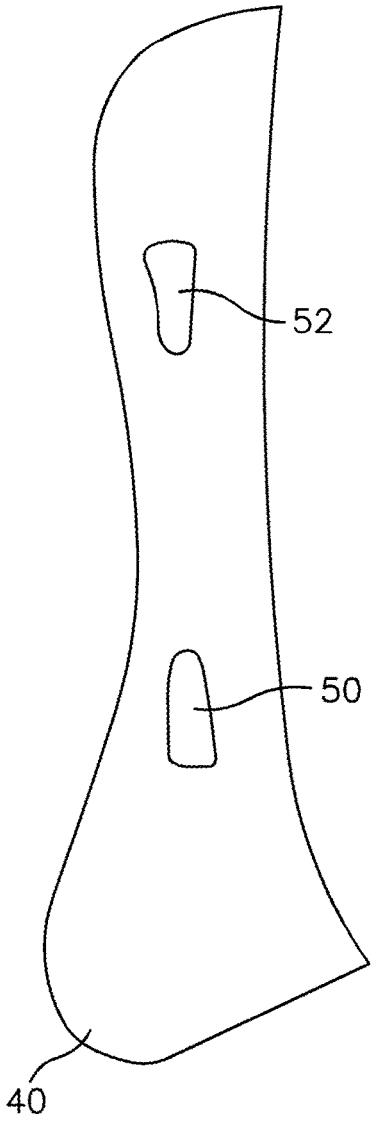
FIG. 8B illustrates a left-side embodiment of a second layer of the flex-plate apparatus disclosed herein.
Figure 8C:
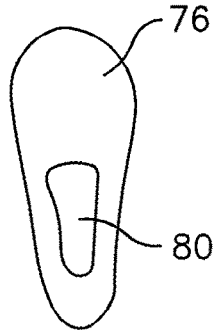
FIG. 8C illustrates a left-side embodiment of a third layer of the flex-plate apparatus disclosed herein.
Figure 8D:
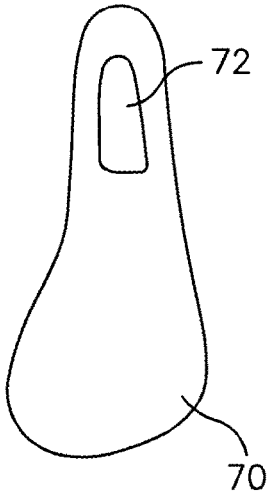
FIG. 8D illustrates a left-side embodiment of a fourth layer of the flex-plate apparatus disclosed herein.

The outer edge 56 of the second layer 40 also includes a linear edge segment 60, as illustrated in FIG. 6. FIG. 7 illustrates that when the apparatus 10 is fully assembled and in position within the pocket 12 of the saddle pad 14, the linear edge segments 30, 60 are positioned proximate the head plate 32 of the saddle tree 34. As best illustrated in FIG. 5, the two upper edges 36, 62 run essentially horizontally along the uppermost portion 38 of the saddle pad 14 pocket 12. In a preferred embodiment, the second layer 40 is fabricated from a polycarbonate material and more preferably is fabricated from Lexan™ with a thickness in the range of 0.015 to 0.025 inches.

As again illustrated in FIG. 6, positioned atop the second layer 40 is a third layer 70 with a lesser surface area than either the first or second layers 16, 40. The third layer 70 includes a fifth cutout 72 of a substantially similar configuration and size as that of the first and third cutouts 26, 50. The fifth cutout 72 is aligned with and overlays the first and third cutouts 26, 50. The surface area of the third layer 70 is preferably between 30 and 50 percent of the surface area of either the first or second layers 16, 40; however, a surface area of the third layer 70 greater than fifty percent or less than 30 percent, is also contemplated by this disclosure. In a preferred embodiment, the third layer 70 is fabricated from a polycarbonate material and more preferably fabricated from Lexan™. In a preferred embodiment, the thickness of the third layer 70 is in the range of 0.030 to 0.050 inches.

As again illustrated in FIG. 6, the fourth layer 76 of the flex-plate apparatus has a surface area less than the surface areas of either the first or second layers 16, 40. The fourth layer 76 includes a sixth cutout 80 of a substantially similar configuration and size as that of the second and fourth cutouts 28, 52. The sixth cutout 80 is aligned with and overlays the second and fourth cutouts 28, 52.

As illustrated in FIGS. 8A-8D, the cutouts 26, 28, 50, 52, 72, 80 of all four layers 16, 40, 70, 76 include a straight segment 84, two roughly parallel side segments 86, 88 and a curved segment 90. When the various layers are overlain these segments are aligned prior to commencement of the bonding process. These cutouts serve the objective of facilitating proper alignment of the plurality of polycarbonate layers during the fabrication of the insert 96. In addition, the cutouts allow for redistributing the pressure applied to the polycarbonate layers in a manner that accommodates the physiology of the Equine. Providing at least one cutout on the first and second layers has been shown to reduce tension within the back muscles of the Equine and decrease wasting of the muscle tissue.

As illustrated in FIG. 6, the first through fourth layers 16, 40, 70, 76 are bonded to each superjacent layer forming the flex-plate apparatus 10. To bond, or adhere, the layers to one another the adhesive Tetrahydrofuran (THF) is preferably utilized. Once adhered to one another using the THF adhesive, the adhesive bonded layers 16, 40, 70, 76 are cured to allow volatilization of organics from the adhesive and to maximize bonding strength.

Once the adhesive has fully cured the multilayered flex-plate 10, as best illustrated in FIG. 4, is encapsulated (sandwiched) between two layers 98 of polyvinyl chloride (PVC). In a preferred embodiment, the thickness of the PVC layers is in the range of 0.10 to 0.150 inches and the layers of PVC are comprised of closed cells with a density in the range of 18 to 20 pounds per cubic foot. In addition, in a preferred embodiment, the PVC layers 98 exhibit a compression of less than six percent according to ASTM D-1667 and a hardness in the range of 60 to 70 according to ASTM D-2240.

As illustrated in FIG. 4, the PVC layers 98 are trimmed to the desired shape and dimensions and then the edges 102, 104 of the two trimmed layers 98 are bonded together using either ultrasonic welding or radio frequency heating. Both processes provide a clean and strong bond between the outer edges 102, 104 of the two layers 98. In addition to the edges 102, 104 the PVC layer 98 on each side of the insert 96 that overlays the cutouts 26, 28, 50, 52, 72, 80 are also welded to the opposite side layer 98. The welding of the layers 98 creates a strong and highly durable encapsulation for the multilayered flex-plate 10.

In operation, the multilayered flex-plate apparatus 10 is inserted into a pocket 12 on each side of the saddle pad 14. FIG. 5 illustrates the saddle pad 14 with a pocket 12 cutaway. Sitting atop the saddle pad 14 is the English saddle 100. The saddle tree 34 as further illustrated in FIG. 7 is the firm, inner part that gives the saddle its stability and main shape. The saddle tree 34 is usually made of plastic or wood and comes in different sizes to accommodate the differing shapes of the back of horses.

FIG. 7 illustrate the location of the head plate 32 of the saddle tree 34. As previously conveyed, the PVC encapsulated linear edge segments 30, 60 of the first and second layers 16, 40 of the multilayered flex-plate 10 are disposed proximate the points 106, 108 of the saddle tree 34 with the points resting upon the widest area W of the first, second and third layers 16, 40, 70 as illustrated in FIG. 9. The wide area W creates a relatively rigid base for the points 106, 108 of the saddle tree 34 to rest upon. Because the points 106, 108 deliver a concentrated application of pressure to the horse and can also interfere with the movement of the scapula S of the Equine, the redistribution of the point loading to the wide area W reduces the restriction of movement of the scapula S of the Equine.

Any different arrangements of the various components depicted, as well as components not shown, are possible without departing from the spirit and scope of the disclosed technology. Embodiments of the disclosed technology have been described with the intent to be illustrative rather than restrictive. Alternative embodiments will become apparent to those skilled in the art that do not depart from its scope. A skilled artisan may develop alternative means of implementing the aforementioned improvements without departing from the scope of the disclosed technology.

It will be understood that certain features and sub combinations are of utility and may be employed without reference to other features and sub combinations and are contemplated within the scope of the claims. Not all steps listed in the various figures need be carried out in the specific order described.

The invention claimed is:

1. An apparatus for insertion into a pocket of a saddle pad of an Equine English saddle, the apparatus comprising:

four flexible layers encapsulated within an outer skin, (a) a first layer with first and second longitudinal ends and a surface area, the first layer further comprising a first cutout proximate the first end and a second cutout proximate the second end;

(b) a second layer of substantially similar configuration and surface area as the first layer, the second layer further comprising a third and fourth cutout;

(c) a third layer with a surface area less than the first and second layers and overlain a portion of the second layer, the third layer further comprising a fifth cutout of a substantially similar configuration and area as that of the first and third cutouts, the fifth cutout overlain the first and third cutouts; and (d) a fourth layer with a surface area less than third layer, the fourth layer overlain a portion of the second layer, the fourth layer further comprising a sixth cutout of a substantially similar configuration and area as that of the fifth cutout, the sixth cutout overlain the second and fourth cutouts; wherein each layer is bonded to each subsequent overlain layer with an adhesive; and the apparatus is positioned within the pocket of the saddle pad preventing interference between a shoulder blade of the Equine with the points of a saddle tree during movement of the Equine.

2. The apparatus of claim 1, wherein the flexible layers are each comprised of polycarbonate wherein the thickness of each layer is in the range of 0.015 to 0.045 inches.

3. The apparatus of claim 1, wherein the encapsulating outer skin is comprised of polyvinyl chloride with a thickness in the range of 0.10 to 0.150 inches.

4. An apparatus for insertion into a pocket of a saddle pad of an Equine English saddle, the apparatus comprising:

(a) a first layer with first and second longitudinal ends and a surface area, the first layer further comprising a first cutout proximate the first end and a second cutout proximate the second end;

(b) a second layer of substantially similar configuration and surface area as the first layer, the second layer further comprising a third and fourth cutout;

(c) a third layer with a surface area less than the first and second layers and overlain a portion of the second layer, the third layer further comprising a fifth cutout of a substantially similar configuration and area as that of the first and third cutouts, the fifth cutout overlain the first and third cutouts; and (d) a fourth layer with a surface area less than third layer, the fourth layer overlain a portion of the second layer, the fourth layer further comprising a sixth cutout of a substantially similar configuration and area as that of the fifth cutout, the sixth cutout overlain the second and fourth cutouts; wherein each layer is bonded to each subsequent overlain layer; and a first and second layer of compressible material between which the four bonded layers are encapsulated; wherein the apparatus is inserted into the saddle pad pocket forming a base for the points of a saddle tree to rest upon thereby creating a larger surface area over which the saddle pressure is spread and reducing the restriction of movement of the scapulae of the Equine.

5. The apparatus of claim 4, wherein the four layers are comprised of a polycarbonate material.

6. The apparatus of claim 5, wherein the thickness of each of the third and fourth polycarbonate layers is in the range of 0.03 to 0.05 inches.

7. The apparatus of claim 5, wherein the thickness of each of the first and second polycarbonate layers is in the range of 0.01 to 0.03 inches.

8. The apparatus of claim 4, wherein the polycarbonate layers are bonded together with an adhesive.

9. The apparatus of claim 4, wherein the first and second layers of compressible material are comprised of polyvinyl chloride.

10. The apparatus of claim 4, wherein the thickness of the polyvinyl chloride layers is in the range of 0.10 to 0.150 inches.

11. The apparatus of claim 4, wherein the layers of polyvinyl chloride are comprised of closed cells with a density in the range of 18 to 20 pounds per cubic foot.

12. The apparatus of claim 4, wherein the polyvinyl chloride layers exhibit a compression of less than six percent according to ASTM D-1667 and a hardness in the range of 60 to 70 according to ASTM D-2240.

13. The apparatus of claim 4, wherein an outer edge of each of the polyvinyl chloride first and second layers are sealed to one another using at least one of (i) ultrasound welding, and (ii) radio frequency heating.

14. The apparatus of claim 5, wherein the polycarbonate layers are comprised of Lexan™.

15. The apparatus of claim 4, wherein the area of the cutout of the third layer comprises in the range of 5 to 15 percent of the total surface area of the third layer.

16. The apparatus of claim 4, wherein the area of the cutout of the fourth layer comprises in the range of 15 to 25 percent of the total surface area of the fourth layer.

17. A system for reducing the restriction of movement of the scapulae of an English saddled Equine, the system comprising:

(a) an Equine English saddle with a saddle tree, the saddle tree further comprising a head and first and second saddle tree points;

(b) a saddle pad with a saddle pocket disposed on each side of the Equine;

(c) a first and second apparatus, each apparatus comprising:

(i) a first layer with a surface area, first and second longitudinal ends, the first layer further comprising a first cutout proximate the first longitudinal end and a second cutout proximate the second longitudinal end;

(ii) a second layer with a surface area as well as third and fourth cutouts each of a substantially similar configuration and size as those respectively of the first and second cutouts;

(iii) a third layer with a surface area and a fifth cutout of a substantially similar configuration and size as that of the first and third cutouts;

(iv) a fourth layer with a surface area and a sixth cutout of substantially similar configuration and size as that of the second and fourth cutouts;

(v) the first, third and fifth cutouts and the second, fourth and sixth cutouts respectively are aligned and bonded into position to form an insert; and (vi) a first and second layer of compressible material between which the insert is encapsulated, the first and second layers of compressible material further comprising an outer edge perimeter with a linear segment transitioning to a plurality of arcuate segments; wherein the first and second apparatuses are inserted respectively into the first and second saddle pockets of the saddle pad creating a base for the saddle tree to rest upon and thereby facilitating movement of each scapula of the saddled Equine when in motion.

* * * * *